US009039467B2

(12) United States Patent
Seipel et al.

(10) Patent No.: US 9,039,467 B2
(45) Date of Patent: May 26, 2015

(54) ELECTRICAL CRIMP CONTACT DEVICE

(71) Applicant: Tyco Electronics AMP GmbH, Bensheim (DE)

(72) Inventors: Volker Seipel, Bensheim (DE); Uwe Bluemmel, Hemsbach (DE); Guido Van de Burgt, Bensheim (DE); Wolfgang Mueller, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 131 days.

(21) Appl. No.: 13/826,652

(22) Filed: Mar. 14, 2013

(65) Prior Publication Data

US 2014/0220835 A1 Aug. 7, 2014

(30) Foreign Application Priority Data

Feb. 1, 2013 (DE) ..... 20 2013 001 074 U

(51) Int. Cl.

| | |
|---|---|
| ***H01R 4/10*** | (2006.01) |
| ***H01R 4/20*** | (2006.01) |
| ***H01R 4/18*** | (2006.01) |
| ***H01R 13/58*** | (2006.01) |

(52) U.S. Cl.

CPC ..... *H01R 4/20* (2013.01); *H01R 4/185* (2013.01); *H01R 13/58* (2013.01); *H01R 2201/26* (2013.01)

(58) Field of Classification Search

CPC ..... H01R 4/20; H01R 4/185; H01R 2201/26; H01R 13/58

USPC ..... 439/877, 865, 878

See application file for complete search history.

(56) References Cited

U.S. PATENT DOCUMENTS

| | | | | |
|---|---|---|---|---|
| 5,338,233 | A | 8/1994 | Endo et al. | |
| 6,232,555 | B1 | 5/2001 | Besler et al. | |
| 2013/0012077 | A1 * | 1/2013 | Sato et al. | 439/877 |

FOREIGN PATENT DOCUMENTS

| | | | |
|---|---|---|---|
| WO | 2011/125626 | A1 | 10/2011 |

* cited by examiner

*Primary Examiner* — Javaid Nasri
(74) *Attorney, Agent, or Firm* — Barley Snyder

(57) ABSTRACT

The invention relates to an electrical contact device and, in particular, a crimp contact device for a cable. The crimp contact device includes a cable conductor connection region and a cable insulation crimp region. The cable insulation crimp region includes a fixing device disposed along an inner surface thereof.

12 Claims, 4 Drawing Sheets

ELECTRICAL CRIMP CONTACT DEVICE

CROSS-REFERENCE TO RELATED APPLICATIONS

This application claims the benefit of the filing date under 35 U.S.C. §119(a)-(d) of German Patent Application No. DE 202013001074.6, filed Feb. 1, 2013.

BACKGROUND

A large number of electrical connectors, particularly plug type connectors, are commonly used throughout electrical engineering and electronics to transmit electric currents, voltages and/or signals with the largest possible range of currents, voltages, frequencies and/or data rates. In particular, in the automotive industry, such known connectors should ensure correct transmission of electrical power, signals and/or data in thermally loaded, dirty, damp and/or chemically aggressive environments for either temporary or permanent periods of time. As a result, known crimp contact devices are commonly used in a large range of applications.

These known crimp contact devices, which may be in the form of a pin, a splice or a socket contact device or apparatus, are configured for use with an electrical cable. For example, the electrical cable may come from a cable harness or on a flexible printed circuit board. In addition to a permanent electrical connection, a permanent mechanical connection may be configured between the cable and a connection region of the crimp contact device. The known crimp contact device may include an insulation crimp region for securing an electrical insulation of the electrical cable, as well as a conductor crimp region for a conductor the electrical cable. In the event where the cable is bent or in the case of high withdrawal force on the cable, the insulation of the cable must not slide out of the closed insulation crimp. Otherwise, impurities and moisture could thereby be introduced into an electrical contact location of the crimp contact device, which may lead to corrosion and/or contact problems.

Both U.S. Pat. No. 5,338,233 and U.S. Pat. No. 6,232,555 disclose known crimp contact devices for an electrical grounding connection or an electrical connection of two flexible printed circuit boards. These known crimp devices include a conductor crimp region for an electrical and mechanical connection of a conductor of an electrical cable, and an insulation crimp region for securing an insulation of the cable. The insulation crimp region includes a single material layer having a crimp base and two crimp sides that are integrally constructed thereon. The material layer of the insulation crimp region has, apart from chamfered free end portions of the crimp sides, an identical material thickness in all the cross-sections thereof. An overall surface for the insulation crimp is comparatively smooth.

Additionally, WO 2011/125626A1 discloses another known contact device that includes a connection region for an electrical connection of a conductor of a cable and an insulation crimp region for mechanically clamping insulation of the electrical cable. The insulation crimp region has a single fixing device for the insulation, which is formed from serrations. However, it has been found during certain testing, such as bending, that these known crimp contact devices allow the insulation of the cable to slide out of the insulation crimp region even when the insulation crimp region is closed, that is to say, crimped, especially in the case of extreme loads.

SUMMARY

Therefore, in view of the aforementioned problems, an object of the invention, among other objects, is to provide an improved electrical contact device having a crimp contact device.

The crimp contact device includes a cable conductor connection region and a cable insulation crimp region. The cable insulation crimp region includes a fixing device disposed along an inner surface thereof.

BRIEF DESCRIPTION OF THE DRAWINGS

The invention is explained in greater detail below with reference to embodiments and the appended drawings. Elements or components which have an identical, univocal or similar construction and/or function are referred to in various Figures of the drawings with the same reference numerals. In the detailed Figures of the drawings.

DETAILED DESCRIPTION OF THE EMBODIMENT(S)

Figure 1:
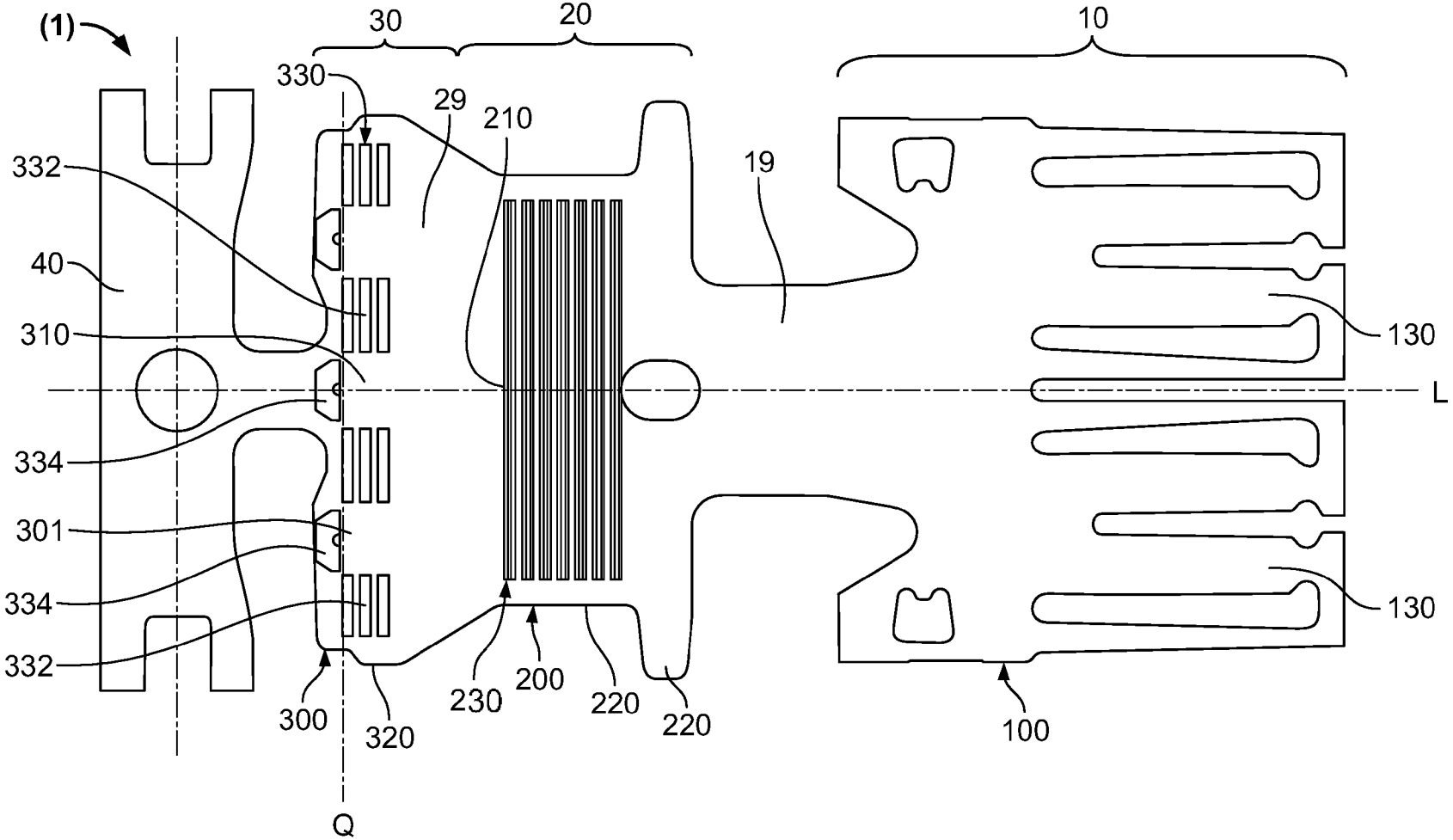
FIG. 1 is a plan view of a punching blank of a crimp contact device with a fixing device according to the invention.

The invention is explained in greater detail below with reference to the drawings, which illustrate exemplary embodiments of a crimp contact device 1 according to the invention.

The crimp contact device 1 can be constructed, for example, straight, curved or angled, and includes a crimp region which is in the form of an insulation crimp region 30 in the shown embodiments. The crimp contact device 1 may be constructed as a socket type device (see FIGS. 1, 4), a tab type device (see FIG. 3), with a pin or a stud, a flat plug (see FIG. 3) or a socket (FIG. 4), etc. It is possible to apply the invention to other known contact devices, which are not mentioned here, as long as those contact devices including the insulation crimp region 30 according to the invention.

For electrical connection, an electrical conductor of a cable (not illustrated in the drawings) can be secured to the crimp contact device 1 without crimping, for example, by means of soldering, compaction welding, etc. The cable may be, for example, an electrical line, a wire or also a component of a cable harness, a cable strand, etc., and the conductor may be a strand, a core or an individual wire. The conductor of the cable may be surrounded by an electrical insulation.

As shown in FIG. 1, a punching blank or a form punching blank for the crimp contact device 1 according to the invention is shown. As such, the crimp contact device 1 is illustrated in an open state, that is to say, before the crimp contact device 1 is bent into a finish form (see FIGS. 2-4).

Figure 2:
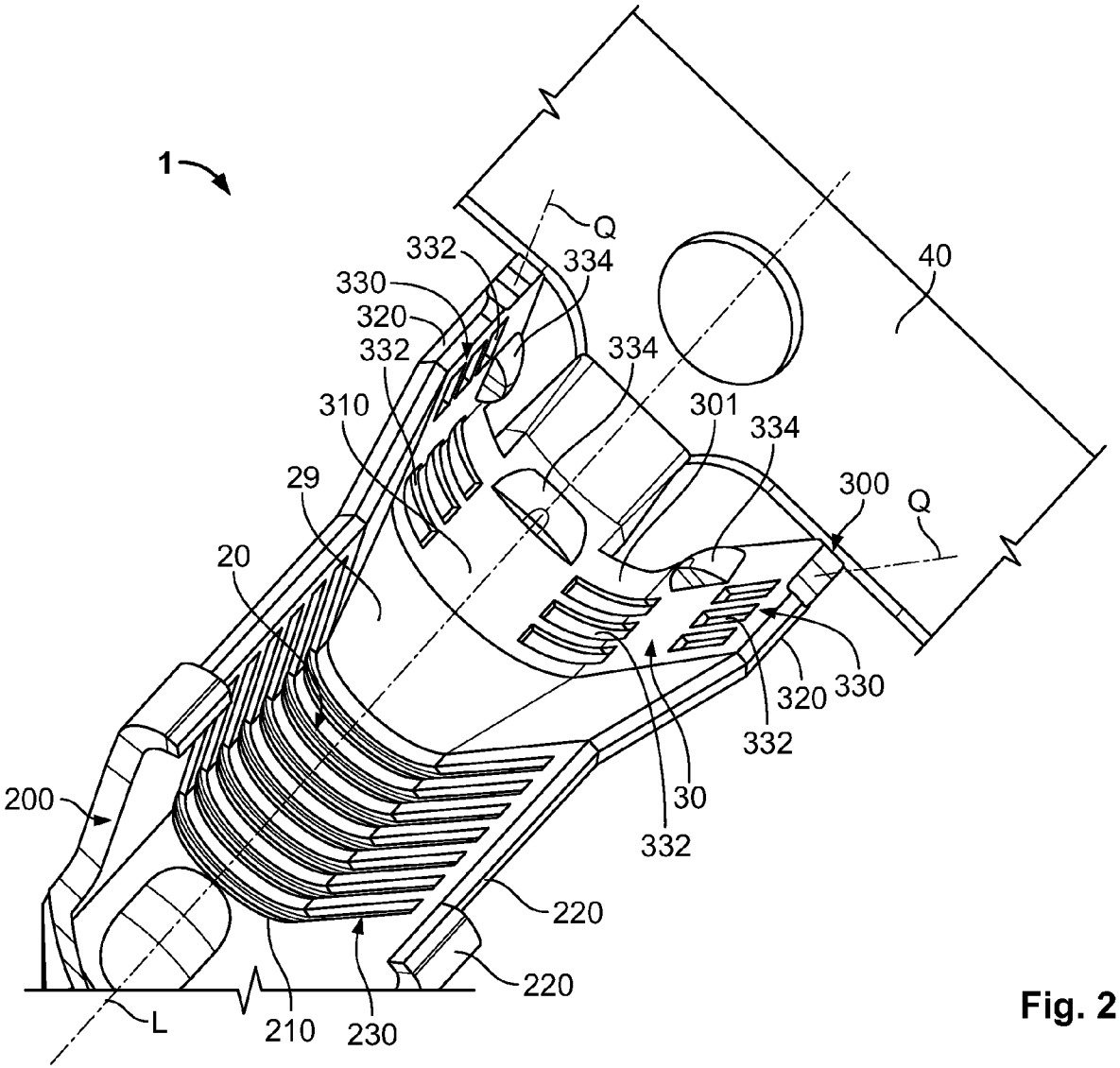
FIG. 2 is a perspective view of a conductor and insulation crimp region of the crimp contact device of FIG. 1, showing the fixing device having seven fixing sections according to the invention.
Figure 3:
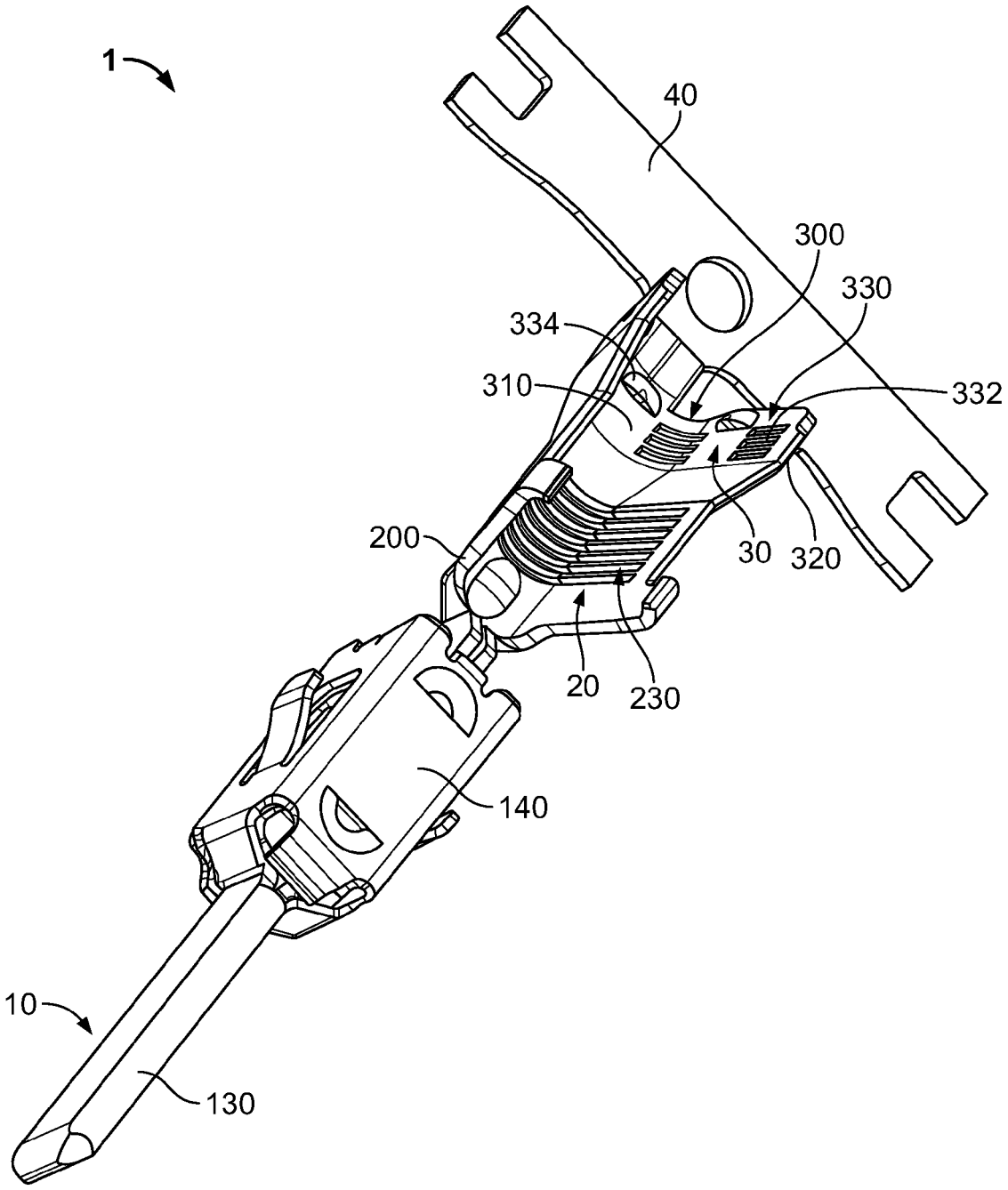
FIG. 3 is a perspective view of another crimp contact device according to the invention.
Figure 4:
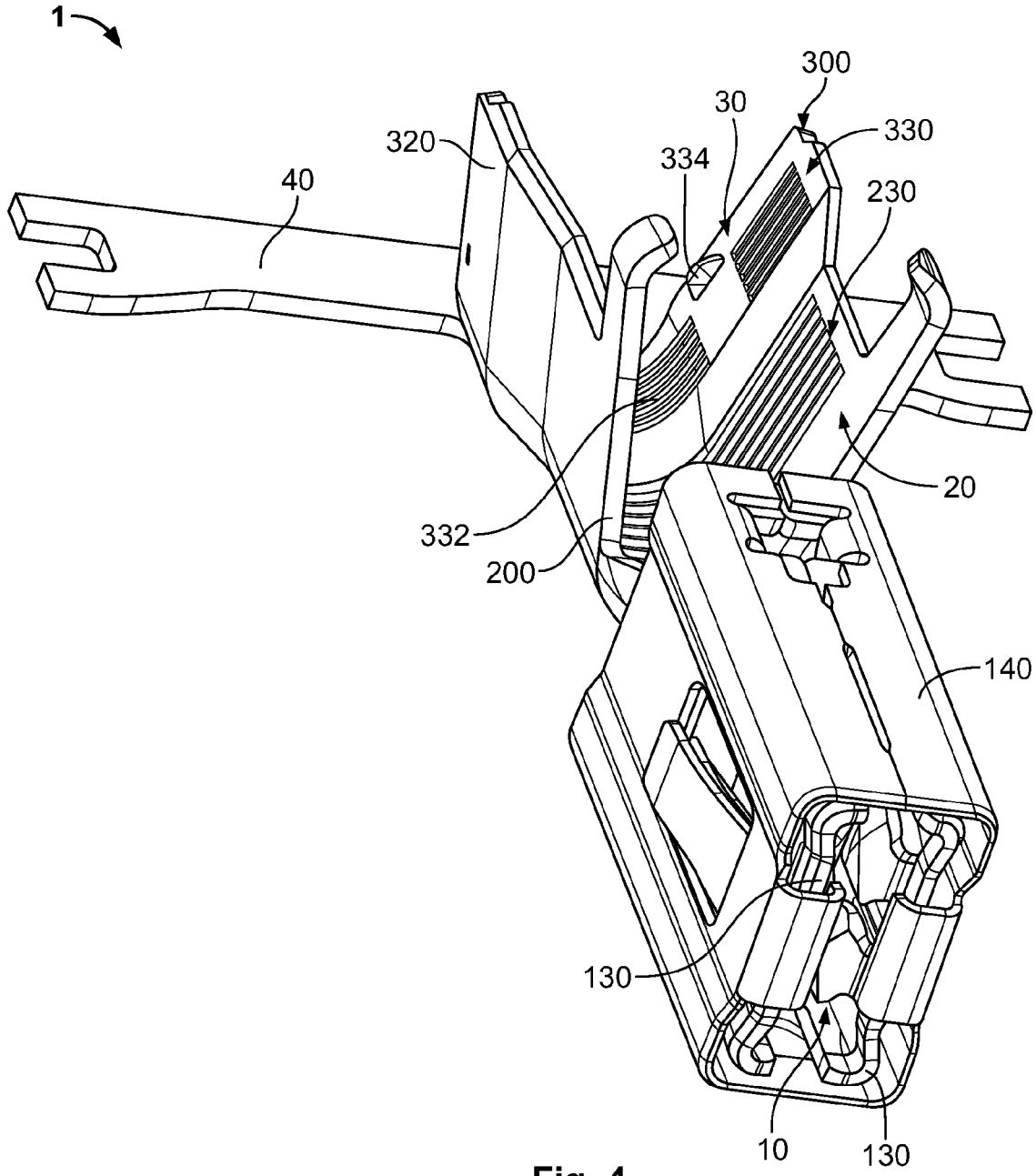
FIG. 4 is a perspective view of another crimp contact device according to the invention.

As shown in FIGS. 2-4, the crimp contact device 1 may include a contact region 10 for electrically and mechanically connecting with a mating contact device (not illustrated). The contact region 10 extends from a transition region 19 which connects to a connection region 20 mechanically connecting with the electrical conductor of the cable. As shown, the connection region 20 is a region on which the conductor of the cable can be crimped.

The connection region 20 extends into a transition region 29, which then extends to an insulation crimp region 30 for the electrical insulation and optionally the conductor (via insulation) of the cable. It may also be referred to as the insulation crimp region 30.

As shown, the crimp contact device 1 is generally punched and suspended from a reel or a conveyor drum 40 after its construction. The crimp contact device 1 can be separated from the reel 40 at a time before, during or after the crimp contact device 1 is crimped. After crimping, the relevant connection and crimp regions 20, 30 may be referred to as a crimp sleeve.

During finishing, the punching blank or form punching blank is bent to form the crimp contact device 1. For instance, a material layer 100 of the contact region 10 is bent to form a tab 130 (see FIG. 3), a contact tongue 130 (see FIG. 4), a contact cage 130 (not illustrated), or a contact box 130 (also not illustrated), etc., which depends on the type of crimp contact device required for a particular application. In this instance, the crimp contact device 1, in particular, may include a tab or contact tongues 130, or a contact cage or box 140 which may be constructed as a separate component and by means of which the actual crimp contact device 1 can be locked, for example, in a housing. Furthermore, the contact cage or box 140 may guide the tab or contact tongue 130, that is to say, limits it in terms of its freedom of movement, in order to prevent it from becoming excessively extended, for example, when the crimp contact device 1 is being handled or during connection to the mating contact device.

Additionally, during finishing, a material layer 200 of the connection region 20 is further bent to form a substantially u-like or v-like connection base 210 (see FIG. 2) and to form one or more crimp side(s) 220, possibly having lug or wings as shown. When the cable is crimped by the connection region 20 (not illustrated), the crimp sides 220 are bent over and a conductor crimp is configured. An inner side of the connection region 20 has a fixing device 230 for the conductor of the cable. That fixing device 230 may include sharp-edged grooves (for instance, serrations) which may break open an oxide layer of the conductor, if present. The fixing device 230 may include aluminium, so that during the crimping of the connection region 20 and the fixing device 230 may ensure partial cold welding and consequently establish a good electrical connection.

As shown in FIGS. 1-4, the crimp contact device 1 is a one piece integrated construction, that is to say, the crimp contact device 1 cannot readily be separated or is held together in a non-positive-locking and/or positive-locking manner. The shown crimp contact device 1 is materially engaging, that is to say, held together in a materially engaging manner and cannot be separated without damaging a component, and produced homogeneously in the sense of from a single piece of material.

In the shown embodiment, the crimp contact device 1 includes the insulation crimp region 30 is adjoined to the connection region 20 along a longitudinal direction L thereof, that is to say, the insulation crimp region 30 is positioned on one side of the connection region 20 that is opposite the contact region 10.

As shown in FIGS. 2-4, the insulation crimp region 30 may have a simple cross-section shape that is substantially u-shaped or v-shaped similarly to the connection region 20 at a time before a crimping operation.

A material layer 300 of the insulation crimp region 30 is substantially aligned with the material layer 200 of the connection region 20. In the crimped state of the crimp contact device 1, the material layer 300 or the insulation crimp region 30 and a corresponding portion of the cable form an insulation crimp. The insulation crimp region 30 has a crimp side 320, which may include a crimp lug or crimp wing as show, similar to the connection region 20 in a manner adjoining a crimp base 310. When the insulation of the cable is crimped by the insulation crimp region 30 (not illustrated), the crimp sides 320 are bent over and the insulation crimp is performed. A mechanical clamping of the insulation is also based mainly or substantially on a friction engagement between the insulation crimp region 30 and the insulation of the cable.

The mechanical clamping of the insulation is may also be supported by a mechanical fixing of the insulation, which may be a positive-locking engagement between the crimp region 30 and the insulation of the cable. For instance, as shown in the Figures, the insulation crimp region 30 may include a fixing device 330 disposed along an inner surface 301 thereof. The fixing device 330 is configured such that that fixing device 330 creates friction between the insulation crimp region 30 and the insulation of the cable, as well as at least partial positive-locking engagement between the insulation and the fixing device 330.

The fixing device 330 secures the electrical insulation and optionally the electrical conductor (via the insulation) of the cable. According to the invention, and shown in the Figures, the fixing device 330 includes at least two fixing sections (332, 332), (332, 334), or (334, 334) that are delimited from each other. In the shown embodiment, two fixing sections 332, 334 which can be distinguished from each other with respect to construction and optionally shape, may be used. As shown in FIG. 2, a first fixing section 332 is provided that is a 3D structural zone having at least one groove and/or rib. Additionally, a second fixing section 334 may be provided that is also a 3D structural zone that includes a different structure, such as a cam, a claw, and/or a hook.

According to the invention, the insulation crimp region 30 may included one or more first and/or second fixing sections 332, 334, which provide a structured inner surface of the insulation crimp region 30. In particular, the first or second fixing sections 332, 334 may include different 3D structures, such as a grooved structure, a fluted structure, a furrowed structure, a serration, a knurled structure, a needle-like structure and/or a combination thereof. The insulation crimp region 30 may, for example, in portions be waved, folded, smooth, roughened, structured, grooved, fluted, knurled, toothed and/or needled. Accordingly, the first or second fixing sections 332, 334 may include at least one recess, a through-hole, an indentation, a notch, a groove, a bead, a protrusion, a ridge, a projection, a rib, a cam, a tooth, a claw, a hook and/or a needle, etc., so as to provide friction and/or positive-locking engagement.

In the shown embodiments, the first fixing section 332 may include a plurality of grooves or ribs and the second fixing section 334 may include at least one individual cam, a claw or an individual hook. The grooves or ribs of the first fixing section 332 may have a height or depth of approximately from 20 to 250 μm, from 40 to 200 μm, from 50 to 150 μm, from 60 to 125 μm, from 70 to 100 μm or from 80 to 90 μm, in each case±from 5 to 20 μm, and preferably ±10 μm. The cam, claw or hook of the second fixing section 334 may have a height of approximately from 40 to 400 μm, from 60 to 300 μm, from 70 to 250 μm, from 80 to 200 μm or from 100 to 150 μm, in each case±from 25 to 50 μm, and preferably ±35 μm.

In the shown exemplary embodiments, the first and second fixing sections 332, 334 of the fixing device 330 are separated from each other, that is to say, they are positioned so as to be delimited relative to each other or excluded from each other. As shown, the first and second fixing sections 332, 334 do not merge or correspond with each other. However, in other embodiments, it is possible that the first and second fixing sections 332, 334 may merge or correspond with each other, for instance, along boundary regions of the insulation crimp region 30.

In particular, as shown in FIGS. 2-4, the first and second fixing sections 332, 334 are provided adjacent to each other. The first and second fixing sections 332, 334 may be provided in a transverse direction Q of the insulation crimp region 30. Optionally, the first and second fixing sections 332, 334 may be positioned in an alternating linear or zig-zag manner such that they substantially bridge the entire transverse direction Q of the insulation crimp region 30, optionally with the exception of the transverse ends or transverse end portions.

In principle, a possible distribution of first and second fixing sections 332, 334 on/in the insulation crimp region 30 may be freely selected. However, selection and positions of the first and second fixing sections 332, 334 may vary so as to be distributed in such a manner that the insulation of the cable does not slide out of the insulation crimp, that is to say, does not slide out of the insulation crimp region 30 of the crimp contact device 1, when the crimp contact device 1 is bent and/or when the cable is angled at the insulation crimp region 30. A combination or several combinations of the first and second fixing sections 332, 334 is/are possible. The first fixing section 332 may deform the insulation of the cable in a resilient manner, while the second fixing section 334 may deform the insulation of the cable in a resilient and optionally plastic manner, for example, by penetration or piercing.

In furtherance, the insulation crimp region 30 may include a plurality of first and second fixing sections 332, 334 in order to provide a fluid-tight connection between the insulation crimp region 30 and the insulation of the cable. This may be brought about, for example, in such a manner that first and second fixing sections 332, 334 are alternately arranged in a staggered manner. As shown, a pair of first fixing sections 332 may be provided and spaced from each other along a transverse direction Q of the insulation crimp region 30. Similarly, a row of second fixing sections 334 may be provided and staggered in relation to each other, as well as the pair of first fixing sections 332. The row of second fixing sections 334 are staggered along a different longitudinal position with spacing from each other in a transverse direction Q. A distance between the pair of first fixing sections is shown large than a distance between the second fixing sections 334.

In shown embodiments, the first fixing section 332 has a plurality of recesses which form a plurality of serrations along an the inner surface 301 of the insulation crimp region 30. In this instance, there may be provided two, three, four, five, six, seven, eight or more recesses at/in the first fixing section 332. The recesses are rectangular or square in the shown embodiments, but could optionally be round shape. The plurality of recesses are also aligned with each other.

In the shown embodiment, the second fixing section 334 includes a protruding structural feature, such as an individual cam, claw or hook. During crimping, the second fixing section 334 engages further into the insulation of the cable than the first fixing section 332. In particular, such the second fixing section 334 may partially cut open the insulation, whereby the insulation is securely held in the insulation crimp region 30 when the insulation crimp is configured. In this instance, the insulation is fluid-tight with respect to the second fixing section 334. The first fixing sections 332 also form a seal.

In one embodiment, a connector, in particular a splice connector, has at least one crimp contact device 1 according to the invention. A splice connector constitutes, for example, a cable connector on which the crimp contact device 1 according to the invention is constructed.

In place of a comparatively heavy copper cable, a comparatively light aluminium cable may be used according to the invention. In order to prevent electrochemical corrosion, in particular in a cable having an aluminium stranded conductor, the electrical insulation of the cable is also crimped at a rear end of the insulation crimp region of the contact device. At a front end, it is possible to produce a durable corrosion protection by crimping additional material and optionally by means of a deposit of a sealing means or a plurality thereof. Such a connection, optionally without the deposit of a sealing means, is naturally also suitable for non-sealed contact devices, for example, in a vehicle interior.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A crimp contact device comprising:
a cable conductor connection region; and
a cable insulation crimp region having a fixing device disposed along an inner surface thereof, the fixing device including
a first fixing section, and
a second fixing section separately positioned from the first fixing section such that the first fixing section is positioned adjacent to the second fixing section, and a material layer thickness of the first fixing section is different than a material layer thickness of the second fixing section.

2. A crimp contact device comprising:
a cable conductor connection region; and
a cable insulation crimp region having a fixing device disposed along an inner surface thereof, the fixing device including
a first fixing section having a recess, and
a second fixing section having a protrusion and being positioned separately from the first fixing section.

3. A crimp contact device comprising:
a cable conductor connection region; and
a cable insulation crimp region having a fixing device disposed along an inner surface thereof, the fixing device including
a plurality of first fixing sections, and
a plurality of second fixing sections separately positioned from the first fixing section, such that the plurality of first and second fixing sections are positioned adjacent to each other, and each of the plurality of fixing sections are spaced from each other along both a longitudinal and a transverse length of the inner surface.

4. The crimp contact device according to claim 3, wherein the plurality of first fixing sections are adjacent to each other along a longitudinal length of the inner surface.

5. A crimp contact device comprising:
a cable conductor connection region; and a cable insulation crimp region having a fixing device disposed along an inner surface thereof, the fixing device including a plurality of first fixing section sets spaced apart from each other along a transverse length of the inner surface and a second fixing section separately positioned from the first fixing section sets, and being structurally different than the plurality of first fixing section sets.

6. The crimp contact device according to claim 5, wherein the cable insulation crimp region includes a plurality of second fixing sections staggered between the plurality of first fixing sections.

7. The crimp contact device according to claim 6, wherein the plurality of second fixing sections are staggered between the plurality of first fixing section sets.

8. The crimp contact device according to claim 6, wherein each of the plurality of first fixing sections includes a ribbed structure, a grooved structure, a fluted structure, a furrowed structure or a serration.

9. The crimp contact device according to claim 8, wherein each of the plurality of first fixing sections has a height or depth of approximately 20 to 250 μm.

10. The crimp contact device according to claim 8, wherein each of the plurality of second fixing sections includes a cam-like structure.

11. The crimp contact device according to claim 8, wherein each of the plurality of second fixing sections has a height of approximately 40 to 400 μm.

12. The crimp contact device according to claim 6, wherein each of the plurality of first fixing sections includes a serration and each second fixing section includes a protrusion.

* * * * *